US012247582B2

(12) United States Patent
Gomes Da Silva et al.

(10) Patent No.: US 12,247,582 B2
(45) Date of Patent: Mar. 11, 2025

(54) FAN SET WITH SUPPORT FOR BEARING FASTENING RING ASSEMBLY AND ASSEMBLY METHOD

(71) Applicant: WEG EQUIPAMENTOS ELÉTRICOS S.A., Jaragua do Sul (BR)

(72) Inventors: Robson Gomes Da Silva, Jaraguá do Sul (BR); Alexandre Schmidt Ferreira, Jaraguá do Sul (BR); Patrick Lafin, Guaramirim (BR)

(73) Assignee: WEG EQUIPAMENTOS ELÉTRICOS S.A., Jaragua do Sul (BR)

( * ) Notice: Subject to any disclaimer, the term of this patent is extended or adjusted under 35 U.S.C. 154(b) by 0 days.

(21) Appl. No.: 18/454,539

(22) Filed: Aug. 23, 2023

(65) Prior Publication Data

US 2024/0401609 A1 Dec. 5, 2024

(30) Foreign Application Priority Data

Jun. 2, 2023 (BR) ..... 1020230109551

(51) Int. Cl.
*F04D 29/62* (2006.01)
*F04D 17/00* (2006.01)
*F04D 29/056* (2006.01)

(52) U.S. Cl.
CPC ..... *F04D 29/626* (2013.01); *F04D 17/00* (2013.01); *F04D 29/056* (2013.01)

(58) Field of Classification Search
CPC ..... F04D 29/04; F04D 29/046; F04D 29/05; F04D 29/056; F04D 29/60; F04D 29/601; F04D 29/62; F04D 29/624; F04D 29/626; F16C 35/07; F16C 35/073; F16C 35/077; H02K 5/16; H02K 5/161; H02K 5/163; H02K 5/165; H02K 5/167; H02K 5/1672; H02K 5/1675; H02K 5/1677
See application file for complete search history.

(56) References Cited

U.S. PATENT DOCUMENTS

| | | | | |
|---|---|---|---|---|
| 3,930,695 A * | 1/1976 | Forrest | F16C 35/077 | 411/338 |
| 2011/0091338 A1* | 4/2011 | Horng | F04D 29/545 | 417/423.12 |
| 2019/0118352 A1* | 4/2019 | Weber | B25F 5/02 | |
| 2023/0256578 A1* | 8/2023 | Bailey | B25F 5/008 | 227/120 |

FOREIGN PATENT DOCUMENTS

| | | |
|---|---|---|
| CN | 213243759 U | 5/2021 |
| DE | 10314299 A1 | 10/2004 |

* cited by examiner

*Primary Examiner* — Elton K Wong
(74) *Attorney, Agent, or Firm* — LUCAS & MERCANTI, LLP

(57) ABSTRACT

The present invention refers to a fan set that has at least one circular support (3) on which a bearing fastening ring (7) can be supported during the process of fastening the closing cover (9) on the bearing already pressed onto the shaft, facilitating the process of assembling the bearing fastening ring (7) and reducing the length of the motor. After the complete fastening of the bearing fastening ring (7), it stops touching the fan, which can rotate freely.

9 Claims, 7 Drawing Sheets

FAN SET WITH SUPPORT FOR BEARING FASTENING RING ASSEMBLY AND ASSEMBLY METHOD

CROSS-REFERENCE TO RELATED APPLICATION

This application claims the benefit of priority from Brazilian Patent Application No. 1020230109551, filed Jun. 2, 2023, the content of which is incorporated herein by reference.

FIELD OF THE INVENTION

The present invention pertains to the field of electrical machines, specifically to the provision of means for assembly and maintenance of components of said machines, more specifically for assembly and maintenance of bearing fastening ring arrangements of the machine.

BACKGROUNDS OF THE INVENTION

In the field of electrical machines, the reduction in size and ease of fastening components has become an increasingly targeted demand, so that, for example, the reduction of its length has been one of the analysis parameters for the proposition of technical solutions.

Currently, the process of fastening the bearing in the motor closing cover, with the bearing already pressed on the shaft, is done with the support and alignment of the operator's hand or another assembly device. This is handled between the fan and the cover to hold the component immobile until the nut, or other suitable fastening element, is fastened to the outside of the cover.

Thus, in order to eliminate the need for manual operation by the operator or another assembling device inside the motor (between the fan and the cover) to keep the bearing fastening ring immobile, the proposed solution is applied to motors that have an internal fan and bearing fastening rings, providing a reduction in the space between fan and cover, previously used by the hand or assembly device. Thus, the operator only needs to support the bearing fastening element (7), with the fastening element also supported, and align said fastening element (8) to assemble the cover, without the need for a support for his/her hand, for example.

STATE OF THE ART

Some documents of the state of the art disclose technologies that fit the same objective of the present invention, in which, however, some unresolved deficiencies still persist.

Document U.S. Pat. No. 3,930,695 discloses two elements that have screws accessible from the outside of the cover and that fasten the bearing by tightening the same at two different points, dispensing with additional internal space for fastening the retainer. In this way, the length of the motor can be reduced and the bearing retainer fastening process is simplified.

Although document U.S. Pat. No. 3,930,695 and the present invention solve similar problems, it should be emphasized that the aforementioned American document uses an element on the outer side of the cover with a screw to fasten the bearing, unlike the present invention, which proposes a fan that facilitates the assembly process of a traditional fastening ring, representing a reduction and simplification of the used components, that is, it uses a smaller and standardized quantity of components, in addition to being used in the internal region of the motor, which is the usual condition for rotating electrical machines.

Document CN213243759 discloses a fan for an electric motor that has two annular shoulders (ring shape) complementary to annular shoulders on the motor cover, aiming at increasing its tightness/sealing through a labyrinth structure. The ventilator has two circular through holes, related to the fastening of a cover by snap-fit on the rear of the ventilator, in order to guarantee the sealing/tightness of the region. This utility model document CN213243759 provides a complex protective structure of the pump rear cover, the pump is motor driven, and the motor includes a rear cover (1), configures the bearing (2) in the rear cover (1) and the motor shaft (3) assembled on the bearing (2), the cover is equipped with a cooling utility fan (4) on the motor shaft (3) of the upper back cover (1).

Despite the visual similarity between the components of the present invention and the elements disclosed in document CN213243759, it is ascertained that, in said Chinese document, functionalities similar to the present invention are not mentioned, mainly regarding the cylindrical regions, since that only a simple through hole was identified to assemble the rear sealing cover. On the other hand, the present invention has a shoulder that serves as a support for assembling/aligning the fastening ring. That is, at first, it is understood that said regions are related to the assembly of the fan on the shaft and its sealing/tightness and, therefore, do not weaken the support functionality for the bearing fastening ring.

Document DE10314299 presents a motor for a screwdriver that has a fan with undercuts/cutouts (72) for the passage of screws that fasten a bearing retainer element without touching/independent of the fan. This document DE10314299 claims an armature bearing for an electric machine, especially for an electric drive machine for an electric tool, with a bearing (38), which can be fastened in the axial direction by means of an end plate (50), to assembling an armature shaft (26) on a housing flange (36), and having a fan wheel (60) which is fastened to the armature shaft (26) and is disposed between the armature (24) and the bearing (38), wherein at least one fastening point of the bearing plate (50) is arranged at least partially within a radial circumference (70) of the fan wheel (60), wherein the fastening point is formed by an axial fastening screw (52), whose screw head points towards the fan wheel (60), wherein the bearing plate (50) is arranged between the fan wheel (60) and the housing flange (36).

The solutions proposed by document DE10314299 and the present invention propose adapting the fan to facilitate the process of fastening the bearing retainer. However, as disclosed in document DE10314299, the body of the fan itself is not used; it is simply a cutout for passing the screws. Furthermore, as disclosed in document DE10314299, the screw is assembled with the head of the screw pointed towards the fan wheel. In this way, for the screw to be fastened, it is necessary that the diameters of the armature (24) and the motor (22) are smaller than the distance between screws (52), allowing the positioning of the tool/device for axially fastening the screws, which is not necessary in the present invention, which allows the reduction in the size of the fastening element and/or the increase of the elements after the fan. Additionally, said document does not mention the advantage of reducing the length of the motor from said solution.

It should be highlighted that none of the documents of the state of the art provide the differential feature of said fan with support for assembling the bearing fastening ring, not mentioning the possibility of using the fan as a support element for the bearing fastening ring. In short, the present invention presents as advantages in relation to the state of the art at least: the reduction of the internal space for handling devices and the reduction of the length of the motor, the simplification of its manufacture, greater ease of management of stock of parts and assembly of the component responsible for fastening the bearing.

BRIEF DESCRIPTION OF THE INVENTION

The present invention relates to a fan set that has at least one circular support in which the bearing fastening ring can be supported during the process of fastening the closing cover on the bearing already pressed on the shaft, facilitating the assembly process of the fastening ring and allowing the motor to be reduced in length. After the fastening ring is completely fastened, it stops touching the fan, which can rotate freely.

BRIEF DESCRIPTION OF THE FIGURES

To assist in identifying the main features of the present invention, the figures to which references are made are presented, as follows.

DETAILED DESCRIPTION OF THE INVENTION

Figure 1:
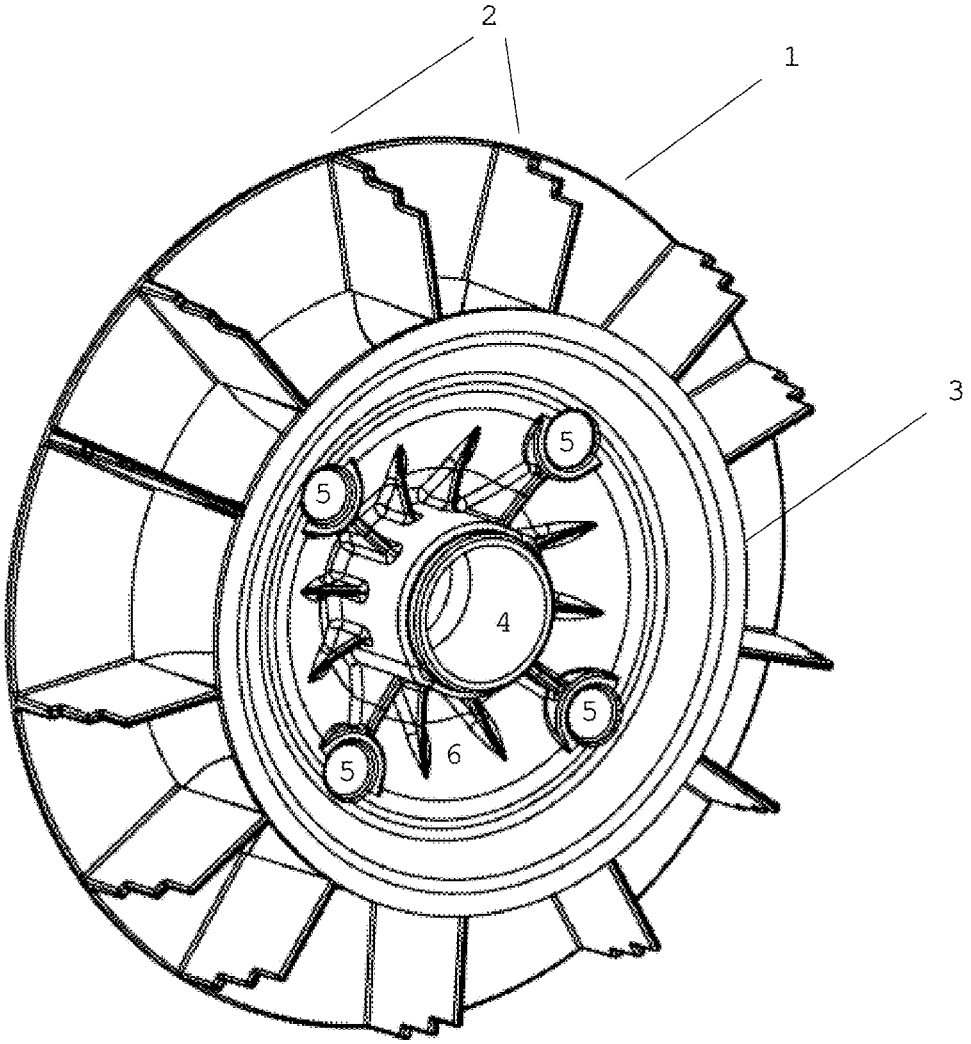
FIG. 1 represents a perspective view of said fan with emphasis on the rear portion of the set of the present invention comprising: optionally a baffle (1); at least two blades (2); a circular support (3) with a fastening hole (4) coaxial in its central portion and at least one prop (5). Alternatively, the present invention may have structural reinforcements (6) along one face of the center hole.
Figure 2:
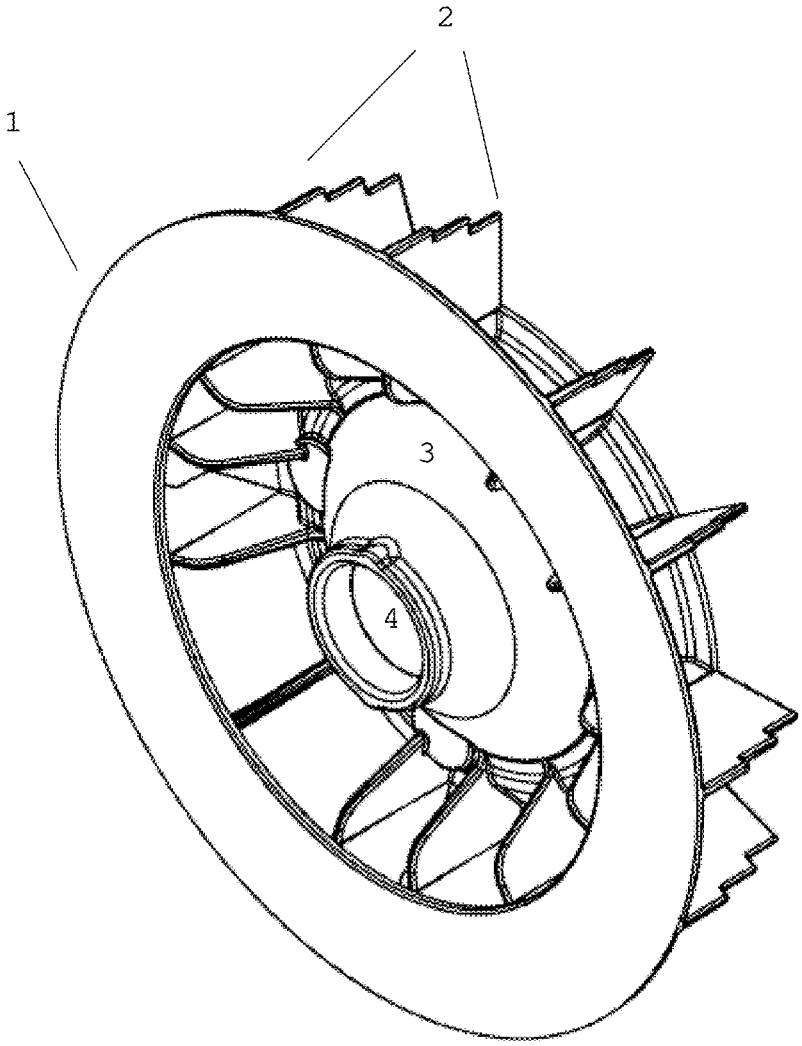
FIG. 2 represents a perspective view of said fan with emphasis on the front portion of the set of the present invention comprising: optionally a baffle (1); at least two blades (2); a circular support (3) with a coaxial fastening hole (4) for fastening the fan on the shaft. Alternatively, the present invention may have at least one prop (5) configured as an undercut and/or shoulder in the rear portion of the set and/or a shoulder and/or undercut in the front portion of said set, depending on the geometry of the fan. Further, alternatively, the side not used as a support for assembling the bearing fastening ring (7), either the front or rear one, can be smooth, not having shoulders and/or undercuts.
Figure 3:
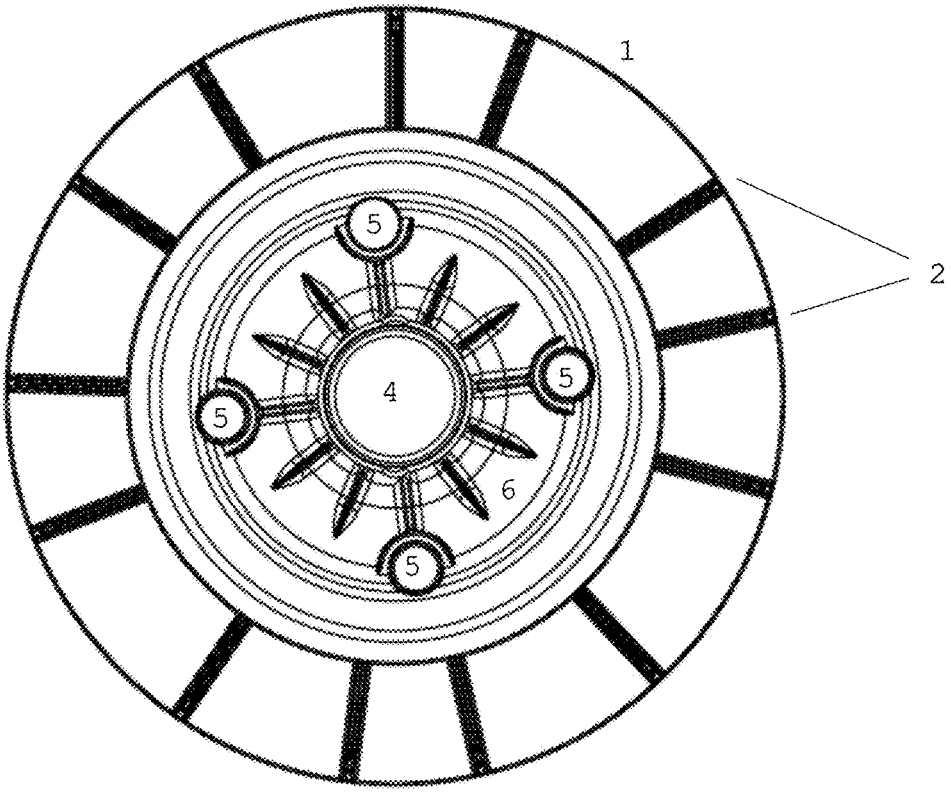
FIG. 3 represents a rear view of said fan with emphasis on the components: optionally a baffle (1); at least two blades (2); fastening hole (4) coaxial for fastening the fan on the shaft; at least one prop (5). Alternatively, the present invention may have structural reinforcements (6) along one face of the center hole.
Figure 4:
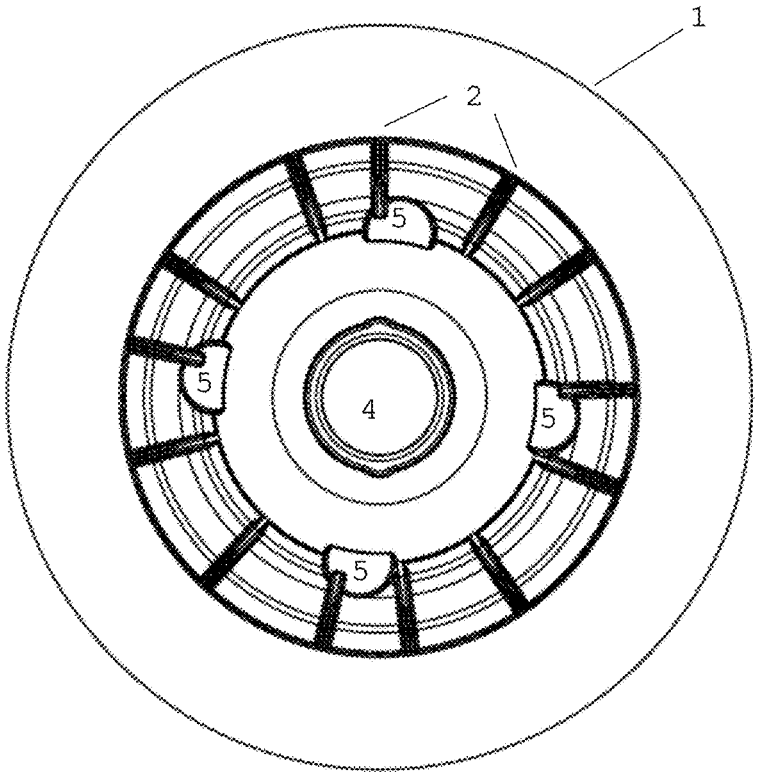
FIG. 4 represents a front view of said fan with emphasis on the components: optionally a baffle (1); at least two blades (2) and a fastening hole (4) coaxial with said fan body.
Figure 5:
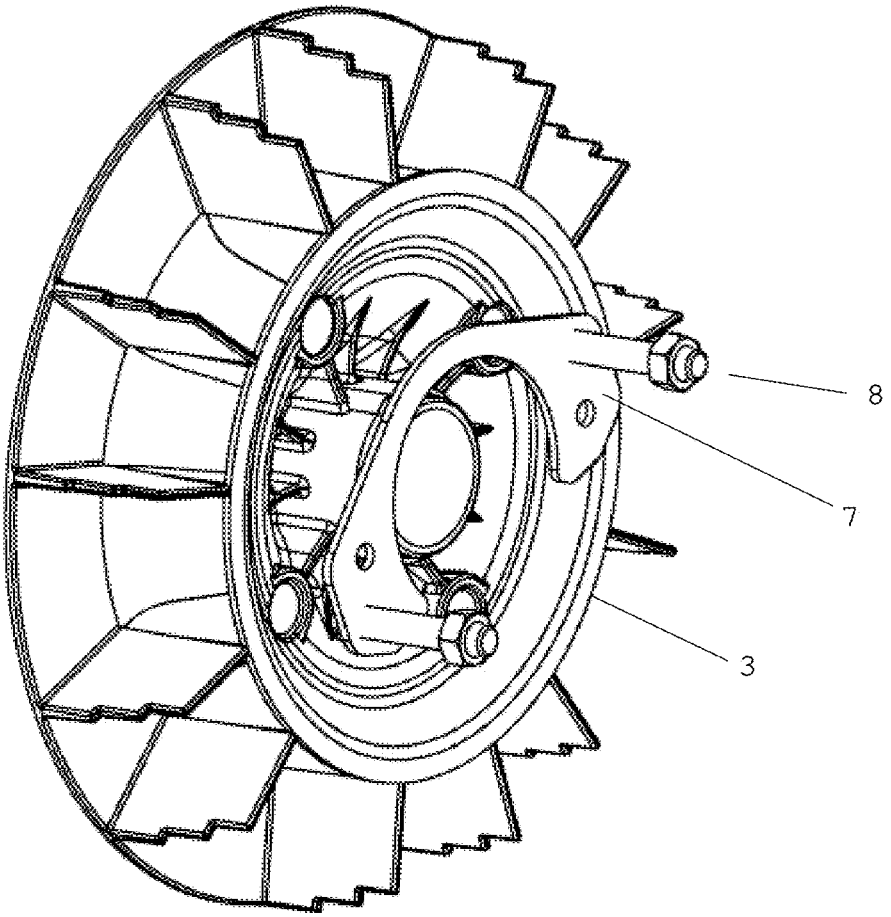
FIG. 5 represents a perspective view of the entire set of said adapted fan, with emphasis on the bearing fastening ring (7) connected to said circular support (3) by at least one fastening element (8).
Figure 6:
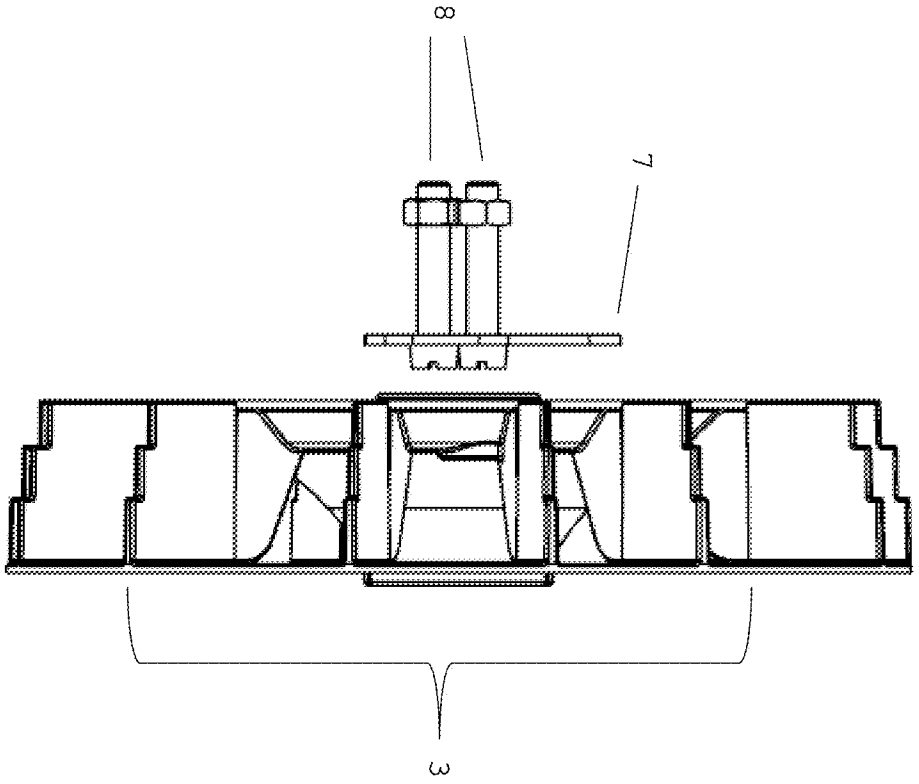
FIG. 6 represents a side view of said fan set, with emphasis on the bearing fastening ring (7) comprising at least one fastening element (8) still not being connected to said circular support (3).
Figure 7:
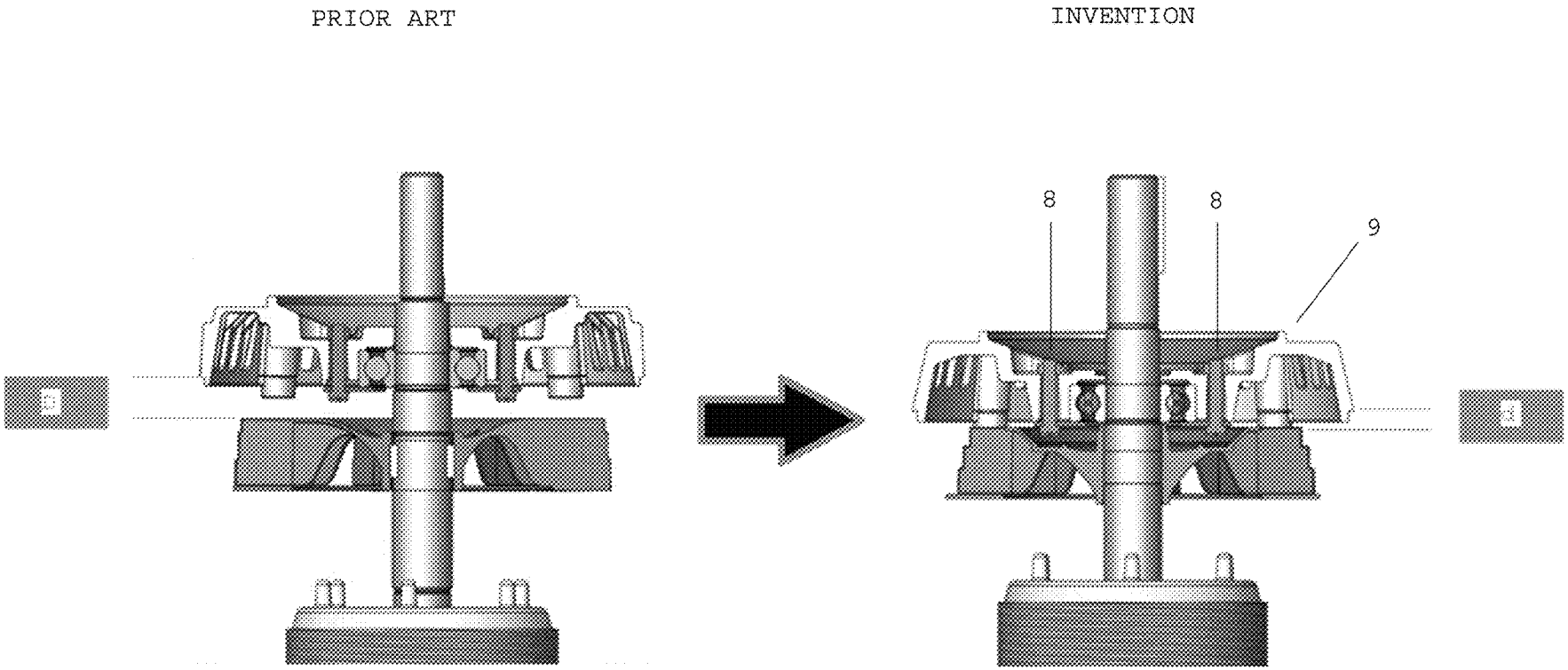
FIG. 7 represents a schematic differentiation between the state of the art and the proposed solution demonstrating the difference between the distances (D) and (d), indicating the decrease in the length of the component due to the reduction of the gap between the closing cover (9) of the motor and the fan.
Figure 8:
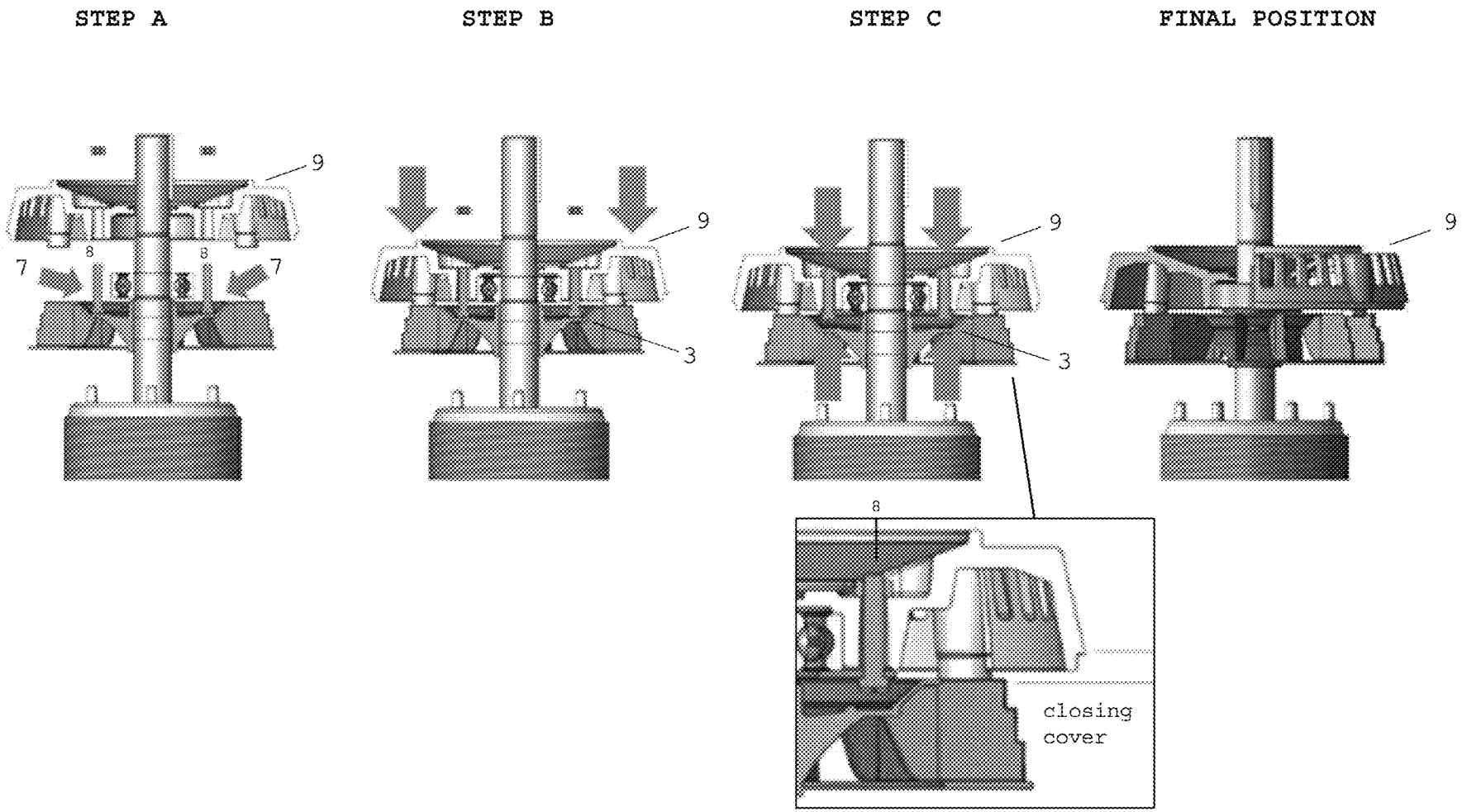
FIG. 8 schematically represents the steps for assembling the bearing fastening ring: A) Positioning the bearing fastening ring (7) on the fan; B) Assembly of the closing cover (9) of the motor on the bearing; C) Positioning and fastening of the fastening elements (8) in the bearing fastening ring and locking the set.

The present invention refers to a fan set with support for a bearing fastening ring specifically used in electrical machines, comprising:

- at least two blades (2) fastened to the front face of a circular support (3); said circular support (3) comprising a coaxial fastening hole (4) for fastening the fan to the shaft;
- at least one prop (5) located on the rear face of said circular support (3); at least one bearing fastening ring (7) connected to said circular support (3) by at least one fastening element (8).

Said fastening element (8) is preferably a reversible fastening element, such as a screw/nut set. Alternatively, said fastening element (8) could be an irreversible fastening element, such as a rivet.

Said blades (2) are fastened preferably, but not limited, perpendicularly to the front face of said circular support (3).

Said bearing fastening ring (7) preferably assumes the shape of a semicircle, and may also assume the shape of a complete circle or interrupted support regions, the operation of the present invention being independent of the geometry of the fastening ring.

In accordance with the fastening ring to be used, the present set preferably comprises a support if the fastening ring (7) is only on one side of the bearing. In addition, the present set preferably comprises at least two supports if the fastening ring is a fastening ring of semicircular or full circular shape.

In one embodiment of the present invention, the supports are required only by the constructive part, but are not mandatory, as they depend on the geometry of the fan base.

Alternatively, the present invention may comprise structural reinforcements (6) along one face of the central fastening hole (4).

The present invention optionally further comprises a baffle (1) connected to said at least two blades (2) in a circumferential direction along the fan shaft.

In the example of the present invention, the fan is directed towards the front of the electric machine (shaft end). However, it should be highlighted that, depending on the design of said machine, the fan could be directed towards the inner part of the same, and the at least one prop (5) would be located in the front portion of the fan set.

It should be highlighted that the use of the invention eliminates the need for the operator's manual operation or another assembling device inside the motor (between the fan and the cover) to keep the bearing fastening ring (7) immobile, using in its place is the circular support (3) of the fan. As a result, the gap between the closing cover (9) of the motor and the fan can be reduced, consequently reducing the length of the motor. After the fastening elements (8) are completely fastened in the bearing fastening ring (7) on the outside of the motor, the bearing fastening ring (7) stops touching the circular support (3) of the fan, and the shaft can rotate freely.

The fan can be manufactured in different ways depending on the material to be used. This concept can be used mainly, but not exclusively, in fans made of polymer, aluminum, cast iron, steel, wood, among others. Said fan is preferably produced from a polymeric material, a blend or a copolymer.

In short, the aforementioned assembly/alignment of the bearing fastening ring (7) is carried out by a method that comprises the following steps:

A) Positioning of the bearing fastening ring (7) on the fan;

B) Assembly of the motor closing cover (9) and positioning of the fastening elements (8);

C) Fastening the fastening elements (8) and, consequently, locking the set, so that the bearing fastening ring (7) does not touch the circular support (3) of the fan.

The easiness of assembly/alignment is obtained by the freedom of the operator to support the bearing fastening ring (7), with the fastening element (8) supported, and align the fastening element (8) of the bearing fastening ring (7) for assembling the closing cover (9), without the need for the operator's hand or additional assembly device to hold the fastening ring (7), facilitating and speeding up the process by having one assembly step less.

As this introduction of an extra support (operator's hand or assembling device) for the bearing fastening ring is not necessary, the distance between the fan and the bearing fastening ring can be reduced. After complete fastening of the bearing fastening ring, this component stops touching the fan and the shaft is free to rotate.

Those skilled on the art will value the knowledge presented herein and will be able to reproduce the invention in the presented embodiments and in other variants, encompassed in the scope of the appended claims.

The invention claimed is:

1. A FAN SET WITH SUPPORT FOR BEARING FASTENING RING ASSEMBLY comprising:

at least two blades (2) fastened to a front face of a circular support (3); said circular support (3) comprising a coaxial fastening hole (4) for fastening the fan set to a shaft;

at least one prop (5) located on a rear face of said circular support (3);

at least one bearing fastening ring (7) connected to said circular support (3) by at least one fastening element (8).

2. THE FAN SET according to claim 1, wherein the bearing fastening ring (7) is in the form of a semicircle, full circle or interrupted support regions.

3. THE FAN SET according to claim 1, wherein the at least one prop (5) is configured as an undercut and/or shoulder in the rear face of the circular support.

4. THE FAN SET according to claim 1, wherein the at least one prop (5) is configured as a shoulder and/or undercut in the front face of the circular support.

5. THE FAN SET according to claim 1, wherein said fastening element (8) is a reversible fastening element.

6. THE FAN SET according to claim 1, further comprising structural reinforcements (6) placed over the at least one prop on the rear face of the circular support.

7. THE FAN SET according to claim 1, wherein it further comprises a baffle (1) connected to said at least two blades (2) in a circumferential direction along the shaft.

8. THE FAN SET according to claim 1, wherein the fan set is made of a polymeric material, a blend or a copolymer.

9. A BEARING FASTENING RING ASSEMBLY METHOD comprising the steps of:

A) positioning at least one bearing fastening ring (7) to connect to a circular support (3) by at least one fastening element (8) of a fan set comprising:

at least two blades (2) fastened to a front face of the circular support (3); said circular support (3) comprising a coaxial fastening hole (4) for fastening the fan set to a shaft;

at least one prop (5) located on a rear face of said circular support (3);

B) assembling a motor closing cover (9) and positioning the at least one fastening element (8) so as to connect the motor closing cover with the fan set;

C) fastening the at least one fastening element (8) and, consequently, locking the fan set with the motor closing cover, while ensuring the at least one bearing fastening ring (7) does not touch the circular support (3) of the fan set.

* * * * *